US005818485A

United States Patent [19]

Rezanka

[11] Patent Number: 5,818,485

[45] Date of Patent: Oct. 6, 1998

[54] THERMAL INK JET PRINTING SYSTEM WITH CONTINUOUS INK CIRCULATION THROUGH A PRINTHEAD

[75] Inventor: Ivan Rezanka, Pittsford, N.Y.

[73] Assignee: Xerox Corporation, Stamford, Conn.

[21] Appl. No.: 754,906

[22] Filed: Nov. 22, 1996

[51] Int. Cl.[6] ..... B41J 2/18; B41J 2/175

[52] U.S. Cl. ..... 347/89; 347/85

[58] Field of Search ..... 347/89, 86, 85, 347/84, 40, 43

[56] References Cited

U.S. PATENT DOCUMENTS

| | | | |
|---|---|---|---|
| Re. 32,572 | 1/1988 | Hawkins et al. | 156/626 |
| 4,638,337 | 1/1987 | Torpey et al. | 347/65 |
| 4,809,015 | 2/1989 | Bowling et al. | 347/74 |
| 4,910,528 | 3/1990 | Firl et al. | 347/17 |
| 4,929,963 | 5/1990 | Balazar | 347/89 |
| 5,017,941 | 5/1991 | Drake | 347/67 |
| 5,189,437 | 2/1993 | Michaelis et al. | 347/47 |

*Primary Examiner*—N. Le
*Assistant Examiner*—Thinh Nguyen

[57] ABSTRACT

An ink jet printing system is provided with a re-circulating ink system which continuously moves ink through the printhead preventing ink thickening or drying out of the ink at the nozzles during non-print periods. Several printhead embodiments are disclosed in which a continuous ink path is established through the printhead by forming ink channels in various internal portions of the printhead. In one embodiment the ink flows through channels formed in an upper substrate through the non-ejecting nozzle area and exits through channels in which the ink heating resistors are located. In other embodiments the ink enters channels formed in an upper substrate and exits through channels formed in a lower substrate. Ink may be ejected through nozzles formed in a nozzle plate or directly from grooves which form a meniscus at the required ink ejection areas. The ink flow requires that a negative pressure gradient be established in the direction of the ink flow so that ink does not weep out at the nozzles or the open grooves as it moves therepast. The required pressures are provided by a pressure head comprising the ink supply reservoir being moved relative to the printhead in conjunction with pump operation to establish the required pressure gradient.

2 Claims, 7 Drawing Sheets

THERMAL INK JET PRINTING SYSTEM WITH CONTINUOUS INK CIRCULATION THROUGH A PRINTHEAD

BACKGROUND OF THE INVENTION AND MATERIAL DISCLOSURE STATEMENT

The invention relates to a ink circulation system for a thermal ink jet printer and, more particularly, to a system for circulating ink in a continuous path through a printhead to suppress the negative effects resulting from short ink latency in the ink channels and nozzles of the printhead.

Thermal ink jet printing can be characterized as a drop-on-demand type of ink jet printing which uses thermal energy to produce a vapor bubble in an ink-filled channel that expels a droplet. A thermal ink jet printhead includes a thermal energy generator or heating element, usually a resistor, located in channels near an ink-ejecting nozzle and a predetermined distance therefrom. The resistors are individually addressed, in response to an input print signal, with an electrical pulse to momentarily vaporize the ink and form a bubble which expels an ink droplet.

In jet printheads can be characterized as "side shooting" system wherein ink is ejected from the sides of the printhead or a "roof shooter" where ink is ejected from the top of the printhead. Examples of a side-shooter printhead are disclosed in U.S. Patents Re: 32,572 to Hawkins, et al. and U.S. Pat. No. 4,638,337 to Torpey, et al. A roof-shooter type of printhead is disclosed in U.S. Pat. No. 4,910,528. In either type of printhead, ink is supplied to the nozzles from an ink reservoir, which can be an ink tank or ink bag which is connected to ink-ejecting nozzles through ink channels. Ink is withdrawn from the ink source by capillary action and under a predetermined negative system pressure. The ink is subsequently ejected through a nozzle by selective energization of an associated heating resistor. The ink that is expelled through the nozzle is almost instantly replaced by ink withdrawn from the reservoir.

Thus the ink circulation of the prior art can be characterized as one of capillary flow. The ink remains quiescent in the ink channel and in the vicinity of the resistor heater and nozzle until the electrical pulse to the resistor heater causes the ink ejection through the associated nozzle. One problem with this type of ink delivery system is that the inks can stagnate in the channel during non-printing intervals. An undesirable consequence of the stagnation is that some water in the ink evaporates causing the ink to thicken and gradually adversely affect the drop ejection. If the printhead remains inactive for a sufficiently long period, ink can eventually completely dry out.

One solution to the ink evaporation problem is to periodically move the ink jet to a maintenance station and prime the printhead forcing ink through the nozzles into a sump. This solution is wasteful of ink and slows throughput of the printing system. Further, some inks, depending on their water concentration, may have a very short latency, requiring a frequent number of visits to a priming station.

SUMMARY OF THE INVENTION

It is, therefore, an object of the invention to provide an ink jet printing system which can accept a broad range of inks with varying degrees of ink latency.

It is a further object of the invention to provide an ink jet printing system which can maintain optimum jetability even after long non-printing periods.

It is another object of the invention to maintain the ink latency of the ink without requiring periodic priming of the printhead.

These and other objects of the invention are realized by providing an ink fluidic circulation system which circulates the ink from an ink reservoir through non-capillary channels past the resistor/nozzle area and back to the ink reservoir in a loop configuration. Appropriate pressures in the ink fluidic channel and at the ink meniscus formed at the nozzle is provided by establishing pressure heads and use of a constant pressure pump.

It is known in the prior art to re-circulate ink through channels that are formed in addition to the capillary channels which bring ink to the ink to the area adjacent to the heating resistors and associated nozzle. U.S. Pat. No. 5,017,941 discloses formation of a side-shooter type of printhead which forms a passageway parallel to an array of heating elements. A cooling fluid, which can be ink, is circulated through this passageway. The purpose of the fluid circulation is to cool the printhead and prevent temperature fluctuations during printhead operation.

U.S. Pat. No. 4,929,963 discloses a roof-shooter type of printhead which includes a non-capillary ink flow channel 38. Ink is circulated through the channel by a low pressure pumping system. The ink that is actually ejected is extracted from ink in the flow channel but is conveyed to a capillary channel 48 (as shown in FIG. 2) which contains the ink heating resistor 45. Ink in channel 48 is thus quiescent during a non-print mode even though ink flow through channel 38 is continuous.

U.S. Pat. No. 5,189,437 discloses a method for making a nozzle plate for an ink jet printhead. In one embodiment, ink is supplied through the nozzles with a positive flow velocity.

U.S. Pat. No. 4,809,015 discloses a printhead with a closed loop ink circulation system (shown in FIG. 2) which includes a pump and filter.

None of the above cited references discloses an ink circulating system which provides a continuous ink movement through the ink discharge area (the heater resistor and nozzle area). The present invention is, therefore, directed to a thermal ink jet printing system wherein ink is continuously circulated through interior channels and nozzles of an ink jet printhead, the system comprising:

a printhead having an ink inlet and outlet and having ink channels formed therein creating a fluidic ink flow path from said inlet to said outlet; said printhead further having a linear array of heating resistors, each resistor associated with one of said nozzles;

electric circuitry for the selective energization of the heating elements to cause ink droplets to be expelled through said associated nozzles;

an ink supply reservoir connected to said inlet of said printhead;

a pump connected between said ink supply reservoir and said catch reservoir, and a regulating system for controlling the pressure gradient and the direction of flow of said ink along said ink path so that ink adjacent to the nozzle during a non-ejecting mode forms a stable, concave meniscus enabling the ink to flow along the ink path without flowing out of the nozzle.

DESCRIPTION OF THE INVENTION

Figure 1:
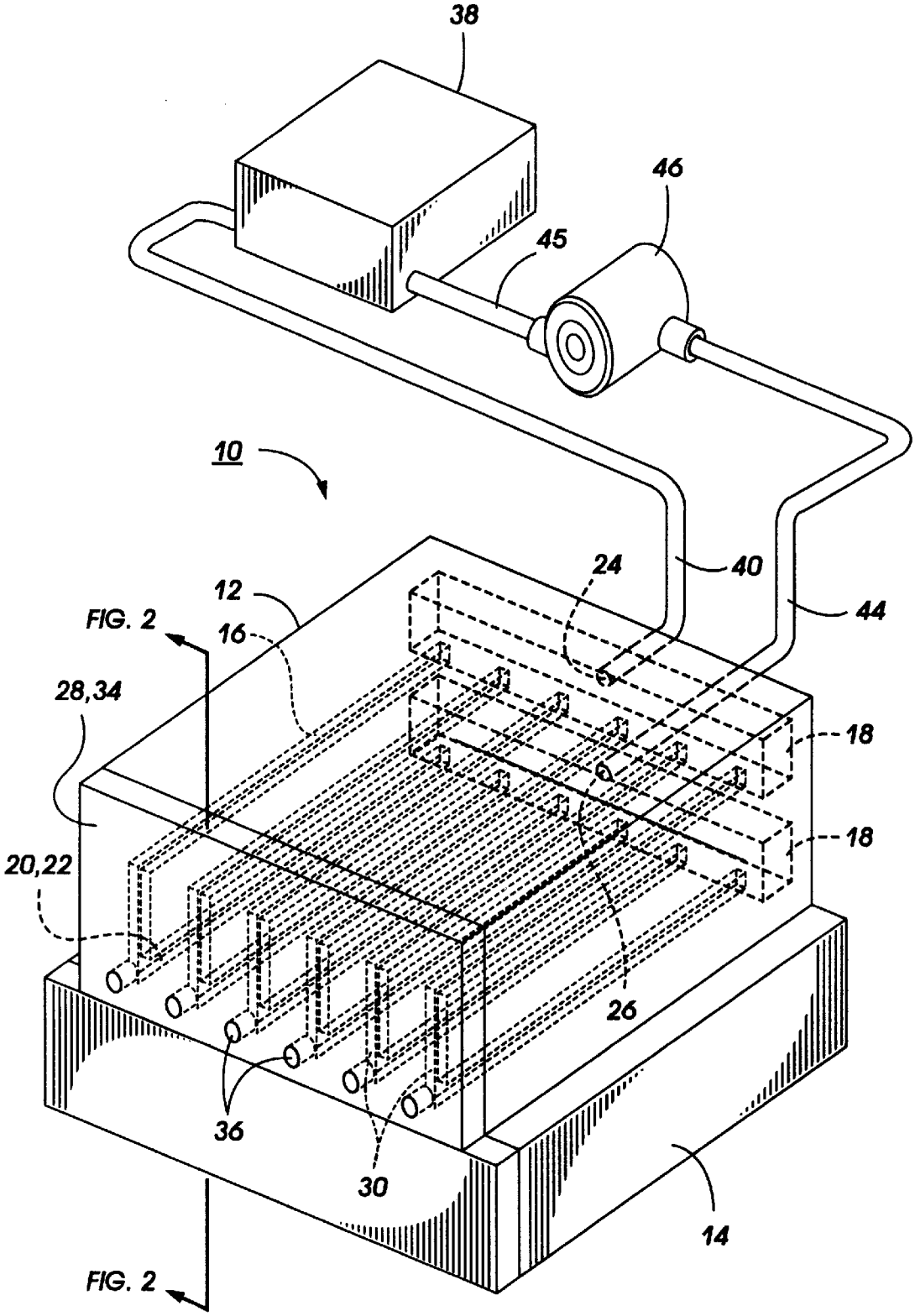
FIG. 1 is a schematic partial isometric view of a printhead showing one embodiment of the continuous ink circulation system of the present invention.
Figure 2:
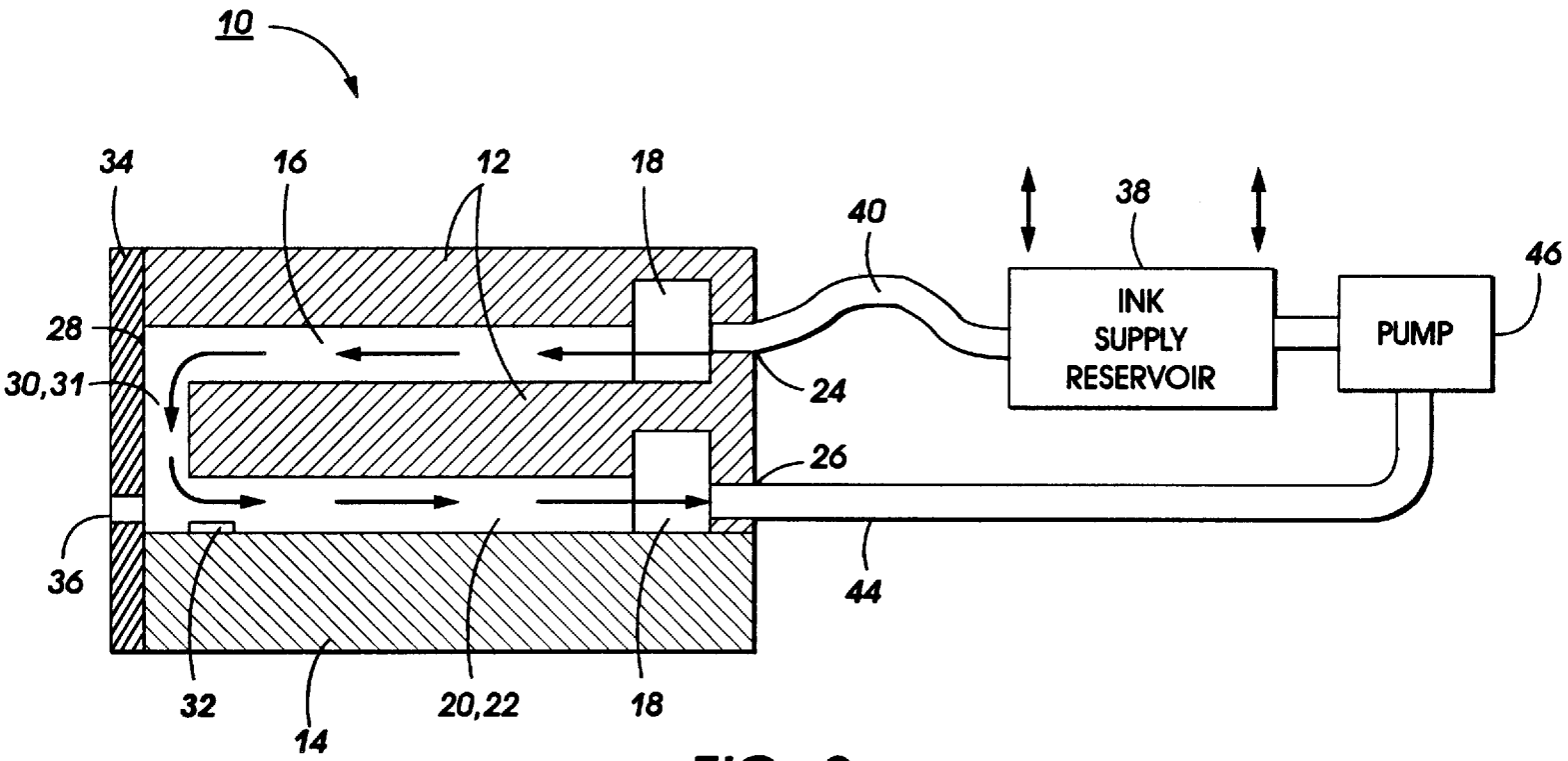
FIG. 2 is a cross-sectional view of the printhead along Line 2—2 of FIG. 1.

Referring to FIGS. 1 and 2, an enlarged schematic isometric view of a first embodiment of a printing system having a continuous ink circulation is shown. A printhead 10 is formed by bonding together a grooved upper substrate 12 to a lower heater substrate 14. The upper substrate 12 has a plurality of ink channels 16 formed therethrough connected to an ink manifold 18. The upper substrate also has a plurality of grooves 20 formed in its lower surface which, when the upper substrate is bonded to the lower substrate, forms channels 22. The back face of the substrate has an ink inlet 24 and an ink outlet 26. The front face 28 of the substrate has a plurality of grooves 30 formed thereon. Heater substrate 14 has a plurality of heating resistors 32 formed on the top surface, each resister positioning at the front end of each of the channels 22. The resistors may be formed on the channel surface or in a pit formed in an overlying insulating layer, as is known in the art.

The front face 28 has an orifice plate 34 bonded thereto; the plate having a plurality of nozzles 36 formed therethrough, each nozzle operatively associated with the heating resistor 32 located in channel 22. Orifice plate 34 overlies groove 30, thereby forming channel 31. It is advantageous to fabricate or modify the inner surfaces of the orifice plate 34 including the surfaces of the nozzles 36, to be wettable by ink, while the front face of the orifice plate 34 is fabricated or modified to be non-wettable by ink.

An ink supply reservoir 38 is connected to ink inlet 24 by tube 40. Pump 46 is connected to ink outlet 26 by tube 44. Pump 46 is also connected to reservoir 38 by tube 45. Reservoir 38 is movable vertically relative to the printhead for reasons explained below. Further details of the printhead construction have been omitted for purposes of simplifying the description of the invention. As is known to those skilled in the art, and with reference to the side shooter patents referenced supra, etching and/or dicing techniques are used to form the ink flow channels and the front face grooves. Interfaces are sealed by use of well known ink-resistive adhesives. Electrical connection from the resistors to drive circuitry is conventional.

Referring still to FIGS. 1 and 2, the ink flow path through printhead 10 is through a rectangular passageway formed by channels 16, channels 31, and channels 22. Steady state flow of viscous fluid through a rectangular channel requires a negative pressure gradient in the direction of the flow. This means that the pressure on the entrance to channel 16 must be higher than at the end of channel 22 where the fluid is leaving the printhead. It is known in addition that the gauge pressure in the ink at the orifice is optimally moderately negative, from −¼ inch of $H_2O$ to −5 inches $H_2O$. This pressure, as well as the pressures needed to overcome the viscous resistances of the ink supply system are provided by opening or equilibrating the ink supply reservoir 38 with the atmospheric pressure and positioning the reservoir at a proper elevation with respect to printhead 10 when printing. As shown in FIG. 2, the printhead and ink supply reservoir are essentially on the same level in stand-by. When printing is required or when a print-ready status is activated, the ink supply reservoir is moved up so that the appropriate pressures, including the pressure drops on the rest of the ink supply system for given ink flow, are achieved. The active element, pump 46, is turn on to pump ink from the printhead to the supply reservoir and back to the printhead. The pressure head between the meniscus and the reservoir is then transporting the ink from the printhead back to the reservoir. This scheme offers sufficient latitude so that only crude feedback or ink monitoring is needed. Since the maximum pressure difference needed to force the ink through grooves 30 on front face 28 is only 5.4 inches $H_2O$; and since the other part of the ink supply system can be made larger, and preferably supplying many jets, the elevation changes can be implemented easily within the confines of the printer.

Figure 3:
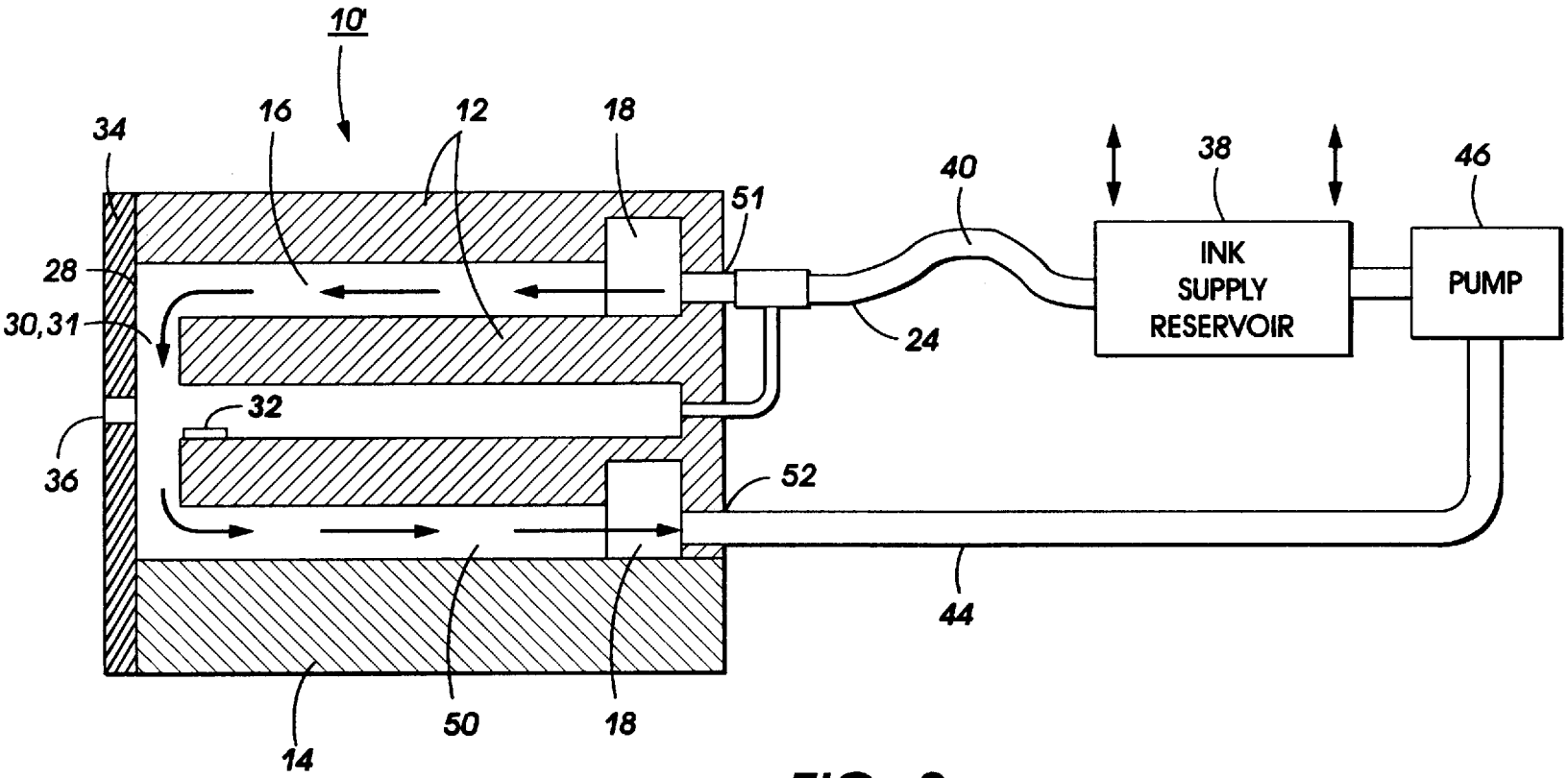
FIG. 3 is a cross-sectional view of a second embodiment of the printhead shown in FIGS. 1 and 2.
Figure 4:
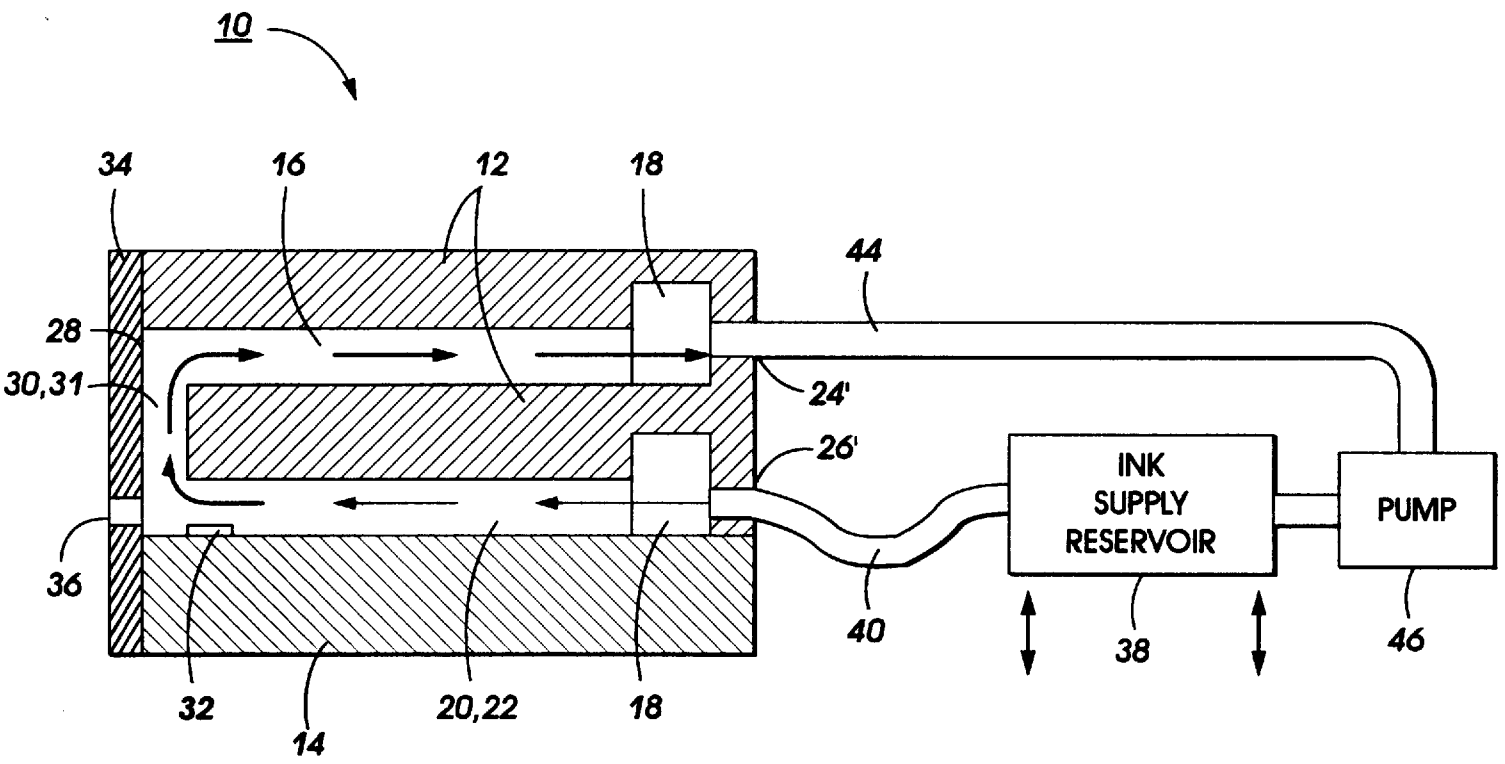
FIG. 4 is a cross-sectional view of a third embodiment of the printhead shown in FIGS. 1 and 2.

Other ink circulation path embodiments are possible consistent with the principles of the present invention. FIG. 3 shows a variation of FIG. 2 with a printhead 10 having additional channels 50 formed in heater substrate 14 beneath channels 22. The ink path, for this embodiment, is from inlet 51 through channels 16, 31, and 50 and exiting at outlet 52. Thus, there is no flow through channels 22 as in the first embodiment FIG. 4 shows another embodiment which has a printhead construction as in FIG. 2 with the pressure heads reversed. Ink is pumped from supply 38 into inlet 26' (outlet 26 in FIG. 2). The flow path is through channels 22, 31, and 16 exiting through outlet 24' (inlet 24 in FIG. 2).

Figure 5:
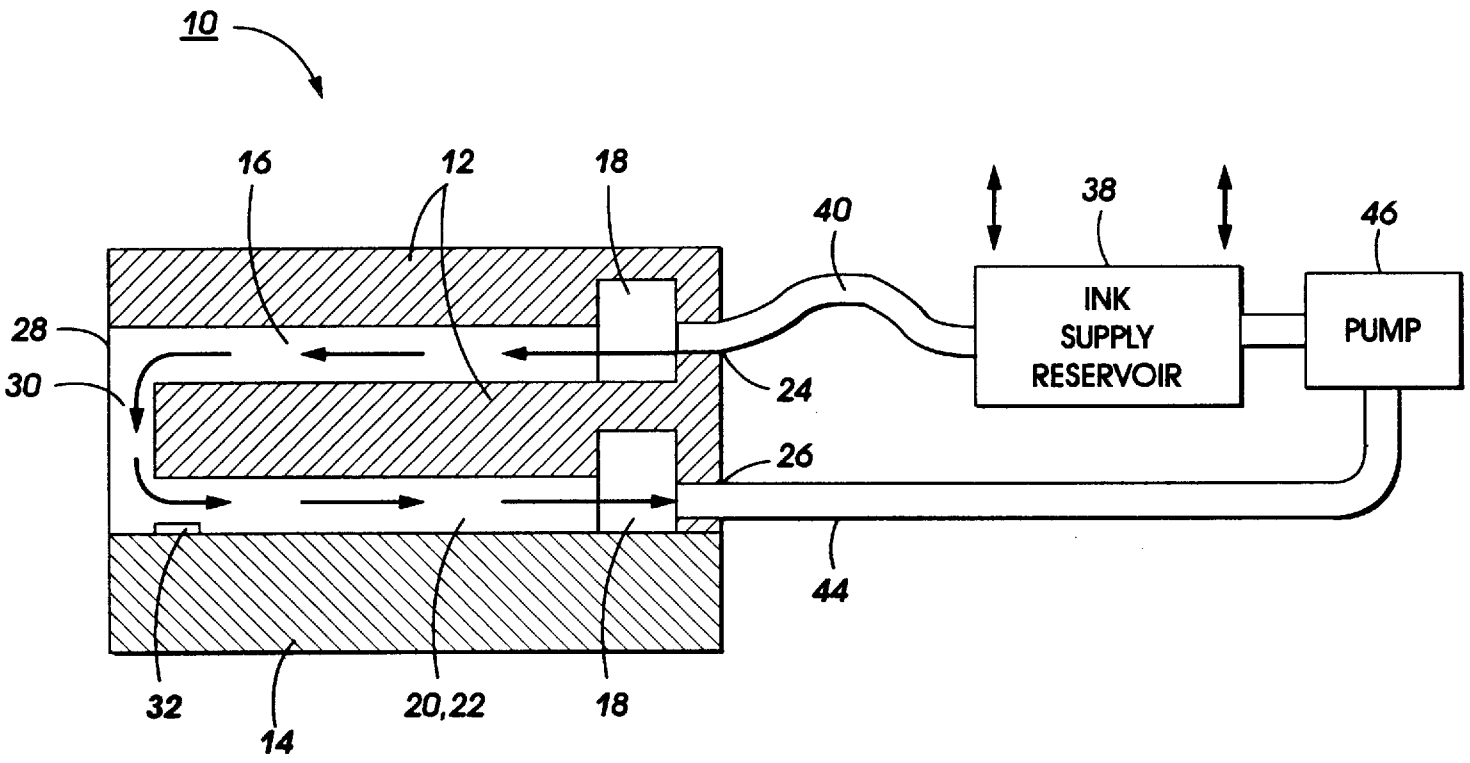
FIG. 5 is a cross-sectional view of the printhead shown in FIG. 2 without the orifice plate.
Figure 6:
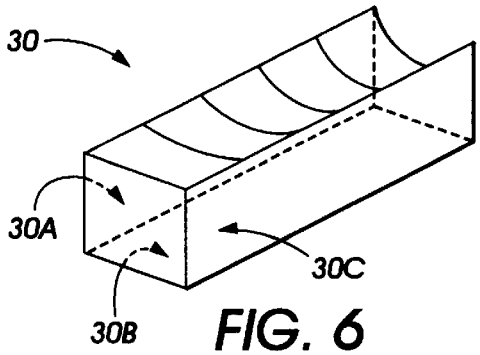
FIG. 6 is an enlarged view of the ink circulation channel shown in FIG. 5.

In some thermal jet embodiments, the orifice plate 34 is not used and the channels are fabricated to provide for the function of the nozzles. Referring to FIG. 5, as in the previous embodiments, the front face of the printhead is rendered non-wettable by ink. In such case, grooves 30 are made in this front face, with one side open to the atmosphere. The inner surfaces of the grooves, surfaces 30A, 30B, 30C (FIG. 6) are rendered wettable by ink. Therefore, the grooves are trenches through which the ink is forced to flow. The flow is directly proportional to the pressure gradient along its direction. If one wall of the channel e.g. groove 30 without orifice plate 34, is open to the atmosphere, the meniscus 33 (FIG. 7B) must support another pressure difference established in the ink, this time the difference between the atmospheric pressure and the pressure inside the ink. Ultimately, the loading capability of the ink meniscus will determine the maximum flow which can be supported in the open channel. The maximum flow which a channel with wall surface wettable by the fluid can support without overflowing out of the channel is one whereby at the entrance the pressure in the fluid is equal to the atmospheric pressure—at higher pressure the fluid will spill out of the channel, while at the exit, the pressure in the fluid is the lowest negative gauge pressure the meniscus can support. Since the pressure in the fluid will change only slowly along the direction of the flow, the meniscus shape at any point is close to part of the cylindrical surface and the lowest exit pressure is $$p_{exit}=-2\ \sigma/a,$$

where $\sigma$ is ink surface tension and a is the channel width. Such situation is schematically shown on FIGS. 6, and 7A, 7B. In such case, the meniscus at the exit has the radius a/2.

Figure 7A:
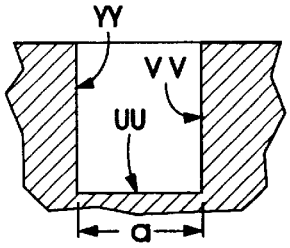
FIGS. 7A, 7B, 7C, and 7D are cross-sectional views of the ink channel shown in FIG. 7.
Figure 7B:
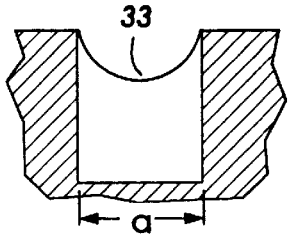
Figure 7C:
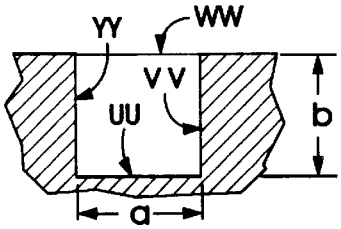
Figure 7D:
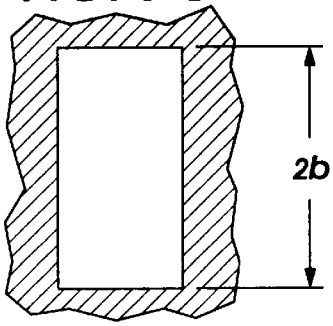

A good approximation for the flow in the open channel as depicted in FIGS. 7A and 7B can be obtained by following analysis. Firstly, it is adequate to approximate the flow by an equivalent, uniform flow with rectangular cross section, with the width a and a depth b, b selected so that the cross section of the equivalent uniform flow will be equal to the average of the entrance and exit flow cross sections in the actual channel. This is depicted on FIG. 7C. The flow in the equivalent uniform channel is defined by the solid surfaces YY, UU, W, and by a free surface WW. In such channel, the solid surfaces YY, UU, W offer a viscous resistance to the flow while the free surface WW presents no hindrance to the flow. It can be clearly seen from FIG. 7D that the same viscous flow is established in each half of a rectangular channel bounded by all four solid surfaces but with the height 2*b* equal to twice the depth b of the equivalent rectangular open channel, due to the symmetry of this case. The steady state volume flow Q through closed rectangular channel can be solved analytically and it is expressed as $$Q=(A^2/\mu F)(dp/dz)$$

where A is the cross section area, $\mu$ ink viscosity, dp/dz pressure gradient, and the factor F is given by a series $$F = 12\eta/1 - (192/\pi^5\eta)\sum_{n=0}^{\infty} \tanh \frac{2(n+1)\pi\eta/2}{(2n+1)^5}$$

where $\eta$ is the aspect ratio of the cross-sectional rectangle.

For a printer capable of 300 spi printing, a reasonable channel width is 60 microns, with a depth of 75 microns. Assuming an ink surface tension of 40 mN/m, this lowest gauge pressure is −5.4 inch of $H_2O$ (−1,330 pascal). The entrance cross section is $1.25a^2$ where a is equal to 60 $\mu$m. The cross section at the exit is smaller by $\pi a^2/8$ than the cross section at the entrance. Taking the average cross section, an approximate flow has a uniform cross section with the depth b equal to a for the calculation of the flow driven by the above determined pressure gradient. Referring to the above presented analysis, the flow in this channel will be exactly equal to half of the flow in a rectangular, closed channel with the same width a but with the height 2*a* and the aspect ratio $\eta$ is here equal to 2. Taking the viscosity of ink equal to 2 cpoise and carrying out the computations we obtain for the volume flow through the open channel $Q_{open}$ $$Q_{open}=4.12\times10^{-6}\ 1/s$$

or, taking 100 pl for drop volume $$Q_{open}=20{,}600\ \text{drops}/s.$$

A drop generation of 21 kHz at 300 spi is significantly above what a typical thermal ink jet printer is required to deliver. Therefore, the concept of the steady state flow of ink through the printhead is validated. Since the maximum pressure difference needed to force the ink through grooves 30 on front face 28 is only 5.4 inch $H_2O$; and since the other part of the ink supply system can be made larger and preferably, supplying many jets, the elevation changes can be implemented easily within the confines of the printer.

The embodiments of FIGS. 1, 2, 4, and 5 are referred to as "side shooter" print systems with the ink being ejected through nozzles formed in the side face of the printhead. The inventive concepts are also applicable to a "roof shooter" printhead of the type disclosed in U.S. Pat. No. 4,910,528.

Figure 8:
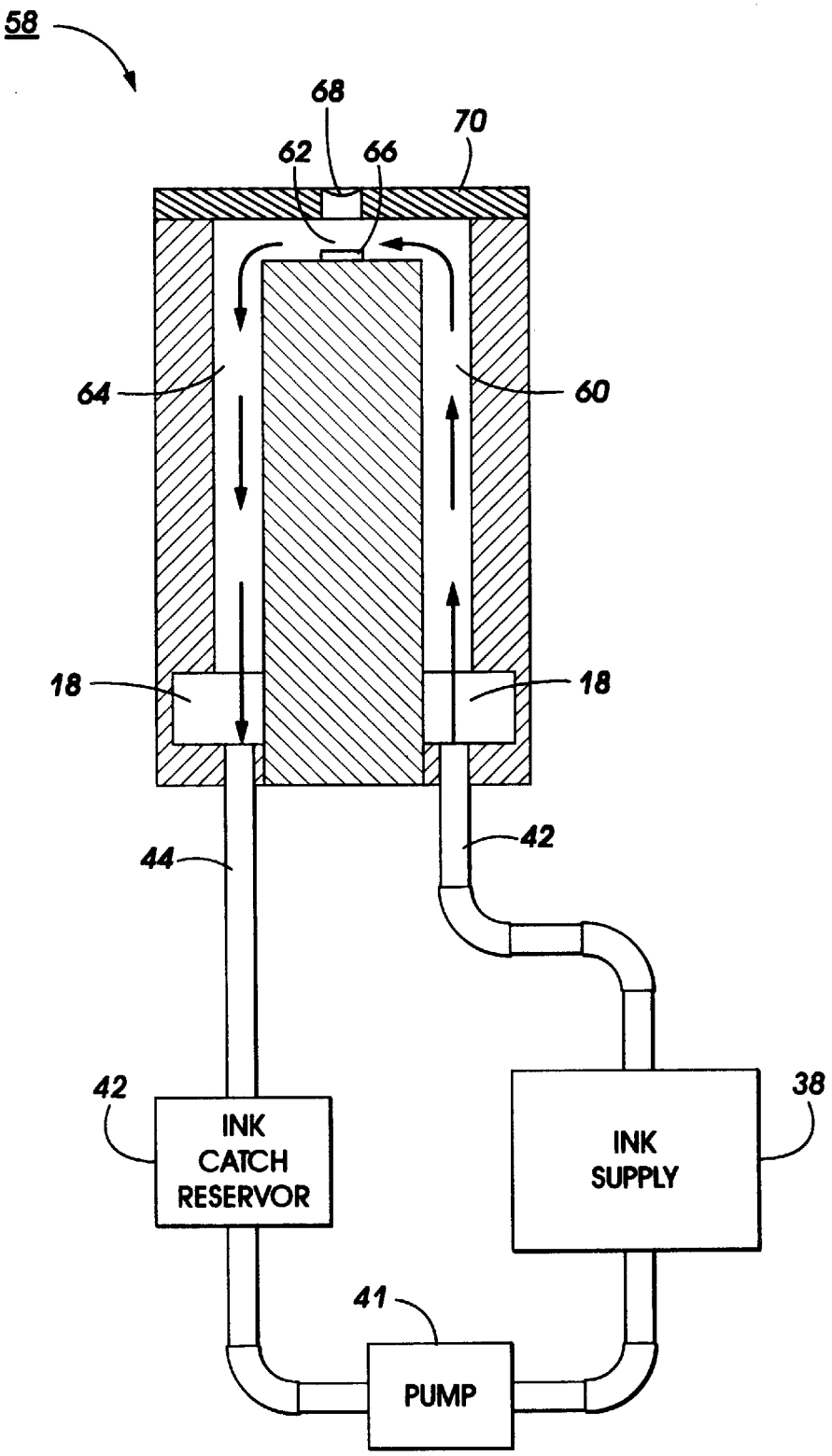
FIG. 8 is a cross-sectional view of a roof-shooter printhead utilizing the ink circulation path of the present invention.

FIG. 8 shows a simplified schematic flow for a roof shooter printhead 58. Re-circulating channels 60, 62, 64 are formed in the printhead substrate. Heater elements 66 are positioned adjacent nozzles 68 formed in orifice plate 70.

While the embodiments herein are preferred, it will be appreciated from this teaching that various alternatives, modifications, or improvements therein may be made by those skilled in the art. For example, the re-circulated ink can be beneficated during re-circulation by placing a filter in the ink circulation path outside the printhead. Alternatively, the ink formulation can be reconstituted.

It will further be appreciated as a desirable vantage of the invention that the ink circulation provides a desirable cooling of the printhead during print operation.

I claim:

1. A thermal ink jet printing system wherein ink is continuously circulated through interior channels and nozzles of an ink jet printhead, the system comprising:

a printhead having an ink inlet and ink outlet and having ink channels formed therein creating a fluidic ink flow path from said inlet to said outlet; said printhead further having a linear array of heating resistors, each resistor associated with one of said nozzles;

electric circuitry for the selective energization of the heating elements to cause ink droplets to be expelled through said associated nozzles;

an ink supply reservoir connected to said inlet of said printhead and open to atmospheric pressure, the reservoir positioned with respect to the printhead so that the pressure at the ink inlet is higher than at the ink outlet and a gauge pressure of the ink at the nozzles is moderately negative, so that ink adjacent to the nozzles during a non-ejecting mode forms a stable, concave meniscus enabling the ink to flow along the ink path without flowing out of the nozzles;

a pump connected between said ink supply reservoir and said outlet and wherein the printhead comprises a first upper substrate having a plurality of channels in communication with the ink inlet, the substrate having a bottom surface with a plurality of grooves formed thereon, and a second lower substrate having said linear array of heating resistors formed on a top surface, the resistors lying in channels formed by said grooves when said first and second substrates are bonded together; said channels connected at one end to said ink outlet and wherein said ink flow extends from the ink inlet through ink channels in the first substrate through channels formed by said grooves and through said channels in which the heating elements are located.

2. A thermal ink jet printing system wherein ink is continuously circulated through interior channels and nozzles of an ink jet printhead, the system comprising:

a printhead having an ink inlet and ink outlet and having ink channels formed therein creating a fluidic ink flow path from said inlet to said outlet; said printhead further having a linear array of heating resistors, each resistor associated with one of said nozzles;

electric circuitry for the selective energization of the heating elements to cause ink droplets to be expelled through said associated nozzles;

an ink supply reservoir connected to said inlet of said printhead and open to atmospheric pressure, the reservoir positioned with respect to the printhead so that the pressure at the ink inlet is higher than at the ink outlet and a gauge pressure of the ink at the nozzles is moderately negative, so that ink adjacent to the nozzles during a non-ejecting mode forms a stable, concave meniscus enabling the ink to flow along the ink path without flowing out of the nozzles, a pump connected between said ink supply reservoir and said outlet and wherein the printhead comprises a first upper substrate having a plurality of channels in communication with the ink outlet, the substrate having a bottom surface with a plurality of grooves formed thereon and a second substrate having said linear array of heating elements formed on a top surface, the resistors lying in channels formed by said grooves when said first and second substrates are bonded together; said channels connected at one end to said ink inlet; and wherein said ink flow extends from the ink inlet through the channels in which the heating resistors are located, through the channels formed by said grooves and through the channels formed in the first substrate.

* * * * *